US007252920B2

(12) United States Patent
Kurokawa et al.

(10) Patent No.: US 7,252,920 B2
(45) Date of Patent: Aug. 7, 2007

(54) METHOD FOR MANUFACTURING POLYMERIZED TONER

(75) Inventors: Hisashi Kurokawa, Tokyo (JP); Makoto Watanabe, Tokyo (JP)

(73) Assignee: Zeon Corporation, Tokyo (JP)

( * ) Notice: Subject to any disclaimer, the term of this patent is extended or adjusted under 35 U.S.C. 154(b) by 257 days.

(21) Appl. No.: 10/803,894

(22) Filed: Mar. 19, 2004

(65) Prior Publication Data

US 2004/0191667 A1 Sep. 30, 2004

(30) Foreign Application Priority Data

Mar. 31, 2003 (JP) ..... 2003-097356

(51) Int. Cl.
*G03G 9/08* (2006.01)

(52) U.S. Cl. ..... 430/137.15; 430/137.11; 430/137.17

(58) Field of Classification Search ..... 430/137.15, 430/137.17, 137.11
See application file for complete search history.

(56) References Cited

U.S. PATENT DOCUMENTS 4,816,366 A * 3/1989 Hyosu et al. ..... 430/137.17
6,495,303 B1 * 12/2002 Kanda et al. ..... 430/137.17
2003/0224276 A1 * 12/2003 Tsuji et al. ..... 430/137.15

FOREIGN PATENT DOCUMENTS

JP 2032363 2/1990
JP 2002-221824 8/2002

* cited by examiner

*Primary Examiner*—Christopher RoDee
(74) *Attorney, Agent, or Firm*—Armstrong, Kratz, Quintos, Hanson & Brooks LLP

(57) ABSTRACT

A method for manufacturing a polymerized toner comprising a process for forming fine droplets of a polymerizable monomer composition in an aqueous dispersion medium, and a process for polymerizing the polymerizable monomer composition after the process for forming fine droplets; wherein the process for forming fine droplets has the steps of: preparing an agitating apparatus having an agitator equipped with an agitating blade or rotor and a dispersion supply tank; providing a polymerizable monomer composition and an aqueous dispersion medium into the dispersion supply tank; then, mixing the polymerizable monomer composition and the aqueous dispersion medium by the agitator to obtain a dispersion of fine droplets; and the relationship between the peripheral velocity of the agitating blade or rotor of the agitator and the number of circulations of the dispersion is controlled.

19 Claims, 1 Drawing Sheet

METHOD FOR MANUFACTURING POLYMERIZED TONER

BACKGROUND OF THE INVENTION

1. Field of the Invention

The present invention relates to a method for manufacturing a polymerized toner, and more specifically to an efficient method for manufacturing a polymerized toner having a very sharp particle diameter distribution and an extremely small quantity of fine powder. The manufacturing method of the present invention is particularly suitable as a method for manufacturing a small particle diameter polymerized toner having a volume average particle diameter within the range between 4 and 9 μm.

2. Description of the Related Art

In image forming machines such as electrographic or electrostatic copying machines, laser-beam printers, and facsimiles, a developer is used for visualizing electrostatic latent images formed on a photoconductive member. The developer contains colored particles (toner) containing a colorant, a charge control agent, a release agent and the like dispersed in a binder resin as the major component thereof.

Toners are roughly divided into pulverized toners obtained by a pulverizing method, and polymerized toners obtained by a polymerization method. In the pulverizing method, a thermoplastic resin are melted and kneaded together with additive components such as a colorant, a charge control agent, and a release agent, and the mixture is pulverized and classified to obtain a pulverized toner as colored resin particles. The pulverized toner has an indeterminate form and a broad particle diameter distribution. Moreover, since fine powder (denoting excessively fine particles hereinafter) is easily formed by pulverization in the pulverized toner, it is difficult to manufacture a small-particle-diameter toner having a desired average particle diameter at a high yield.

In the polymerization method, a polymerizable monomer composition containing a polymerizable monomer, a colorant, and other additive components is polymerized in an aqueous dispersion medium to form a polymerized toner as colored polymer particles. In the polymerization method, the formed colored polymer particles are washed, filtered, and dried after polymerization to obtain a polymerized toner.

According to the polymerization method, a spherical polymerized toner with a relatively sharp particle diameter distribution can be manufactured. Also according to the polymerization method, core-shell structure colored polymer particles can be formed by polymerizing a polymerizable monomer for the shell after the polymerization of the polymerizable monomer composition, in the presence of the formed colored polymer particles. If the glass transition temperature of the polymer component constituting the core is lowered, and the glass transition temperature of the polymer component constituting the shell is elevated, a polymerized toner that excels both in shelf stability and low-temperature fixing properties can be manufactured. Furthermore, according to the polymerization method, a polymerized toner having a volume average particle diameter of 10 μm or less, preferably 4 to 9 μm, can be easily manufactured. The polymerized toner, can therefore form a high definition and high quality image and is suitable also for increasing a printing speed and forming a full-color image.

Thus, a polymerized toner of a small particle diameter plays an extremely important role on the formation of high-precision and high-quality images. However, various problems have arisen as the particle diameter of the polymerized toner is reduced. For example, in order to lessen the particle diameter of the polymerized toner, the dispersion containing a polymerizable monomer composition must be dispersed using an agitator, to form fine droplets of the polymerizable monomer composition, in the droplet forming step preceding the polymerizing step. However, if the particle diameter of the droplets becomes less, the viscosity of the dispersion elevates significantly, resulting in the difficulty of forming the droplets (the process for forming fine droplets), and lowering the agitating efficiency of the agitator.

In addition, when the particle diameter of the droplets becomes less, the proportion of formed fine powder increases remarkably, and highly sharp particle diameter distribution becomes difficult to materialize. As a result, fog increases, and the printing density lowers. If the proportion of fine powder is large, the fine powder must be removed from the colored polymer particles by classification, resulting in complicated process and high costs. Therefore, in order to form the images of high definition and high quality, the establishment of the art for efficiently manufacturing a polymerized toner is desired, which toner having an adequately small average particle diameter, a very sharp particle diameter distribution, and an extremely low content of fine powder.

Conventionally, there has been proposed a process, wherein a dispersing machine, having a combination of a rotor and a stator that are concentric comb-teeth rings is used as an agitating apparatus, and is constituted so as to drive the rotor to rotate at a high speed to flow the dispersion from the inside of the rotor to the outside of the stator, and to agitate the dispersion in the gap between the rotor and the stator (Japanese Patent Laid-Open No. 2-32363/1990). In other words, in this prior art, a method for manufacturing a polymerized toner is disclosed, wherein the step for dispersing a monomer composition containing a polymerizable monomer and a colorant into an aqueous dispersion medium to form suspension particles (droplets) is a step for flowing the monomer composition from the inside of the rotor toward the outside of the stator.

However, it is difficult to obtain a polymerized toner, having a small particle diameter, an extremely sharp particle diameter distribution, and a small proportion of fine powder, only by adopting a dispersing machine such as Ebara Milder (manufactured by Ebara Corporation).

Then, there has been proposed a method, wherein the tip speed (peripheral velocity) of an agitating blade (rotor) of an agitator and the internal pressure of the agitating section are controlled so that the relationship thereof satisfies a specific formula, in the process for forming fine droplets of a polymerizable monomer composition using an agitating machine such as Ebara Milder (Japanese Patent Laid-Open No. 2002-221824). According to the method disclosed in this prior art, a polymerized toner having a small particle diameter and a sharp particle diameter distribution can be obtained. However, the proportion of fine powder is not sufficiently reduced only by controlling the relationship between the rotor of the agitating apparatus (dispersing machine) and the internal pressure, and the speed of the formation of droplets having a desired average particle diameter is not sufficiently high. Therefore the process, materializing sufficient reduction of fine powder and high speed formation of droplets having a desired average particle diameter, is desired.

BRIEF SUMMARY OF THE INVENTION

The object of the present invention is to provide a method for efficiently manufacturing a polymerized toner having a very sharp particle diameter distribution and an extremely small proportion of fine powder.

More specifically, the object of the present invention is to provide a method for manufacturing a polymerized toner having a very sharp particle diameter distribution and an extremely small proportion of fine powder by a polymerization method, wherein the design of processes for manufacturing a polymerized toner with a desired average particle diameter is easy, and the process for forming fine droplets can be efficiently performed.

The inventors of the present invention focused on the fact that the sharpening of the particle diameter distribution of a polymerized toner and the reduction of the proportion of fine powder are effectively performed by improving the process for forming fine droplets of a polymerizable monomer composition, and analyzed the factors influencing the particle diameter distribution and the formation of fine powder. As a result, the inventors found that the above described object could be achieved by the process for forming fine droplets comprising the steps of preparing an agitating apparatus having an agitator equipped with an agitating blade or rotor and a dispersion supply tank, providing a polymerizable monomer composition and an aqueous dispersion medium into the dispersion supply tank, then, mixing the polymerizable monomer composition and the aqueous dispersion medium by the agitator to obtain a dispersion of fine droplets, optionally feeding back the dispersion into the dispersion supply tank and circulating the dispersion, and providing the dispersion to the process for polymerizing; and by controlling R/θ and R, wherein the peripheral velocity (m/s) of the agitating blade or rotor of the agitator is designated by R, and, the number of circulations, represented by {throughput of the dispersion (liter/h)×agitating time (h)}/{provided quantity of the polymerizable monomer composition and the aqueous dispersion medium (liter)}, is designated by θ.

In the method of the present invention, by elevating the peripheral velocity (tip speed) of the agitating blade (rotor), the throughput of the dispersion can be increased even if the fine droplets of a small particle diameter are to be formed, and the process for forming fine droplets can be performed efficiently. According to the method of the present invention, droplets of a target particle diameter can be quickly formed. Furthermore, according to the method of the present invention, the process for forming fine droplets using a relatively small agitating apparatus (dispersing machine or particle forming machine) is possible.

The polymerized toner obtained by the method of the present invention excels in printing density and resolution, cause little fog, and excels in cleaning properties. The present invention was completed on the basis of these findings.

Thus, according to the present invention, there is provided a method for manufacturing a polymerized toner comprising a process for forming fine droplets of a polymerizable monomer composition containing a polymerizable monomer and a colorant in an aqueous dispersion medium, and a process for polymerizing the polymerizable monomer composition after the process for forming fine droplets; wherein (1) the process for forming fine droplets comprising the steps of:

preparing an agitating apparatus having an agitator equipped with an agitating blade or rotor and a dispersion supply tank;

providing a polymerizable monomer composition and an aqueous dispersion medium into the dispersion supply tank; then, mixing the polymerizable monomer composition and the aqueous dispersion medium by the agitator to obtain a dispersion of fine droplets;

optionally, feeding back the dispersion into the dispersion supply tank and circulating the dispersion; and providing the dispersion to the process for polymerizing, and (2) R/θ is 2 or more, and R is 30 m/s or more, wherein the peripheral velocity (m/s) of the agitating blade or the rotor of the agitator is designated by R, and the number of circulations, represented by {throughput of the dispersion (liter/h)×agitating time (h)}/{provided quantity of the polymerizable monomer composition and the aqueous dispersion medium (liter)), is designated by θ.

DETAILED DESCRIPTION OF THE INVENTION

Figure 1:
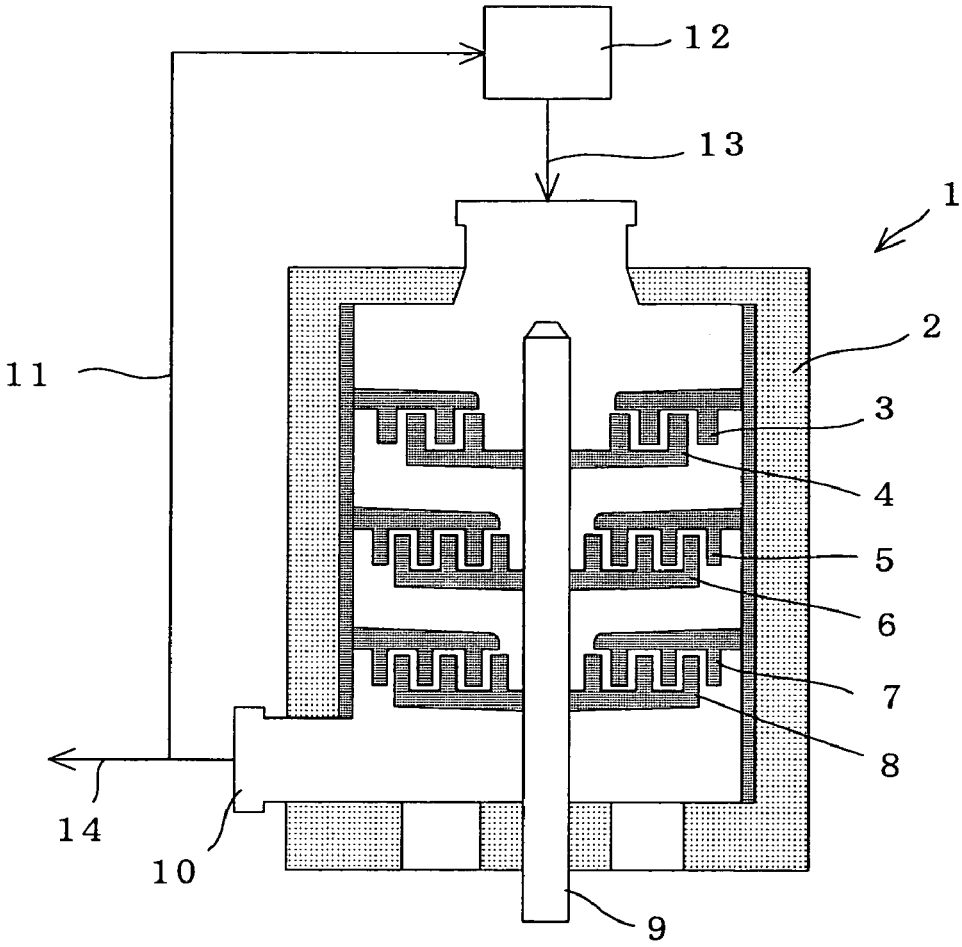
FIG. 1 is a schematic diagram of a specific example of an agitating apparatus used in the process for forming tine droplets of the present invention.

1. Method for Manufacturing Colored Polymer Particles by Polymerization Method A polymerized toner is colored polymer particles, wherein additive components such as a colorant, a charge control agent, and a release agent are dispersed in a binder resin composed of a polymer formed by the polymerization of a polymerizable monomer. The method for manufacturing a polymerized toner of the present invention includes a process for forming fine droplets of a polymerizable monomer composition containing a polymerizable monomer and a colorant in an aqueous dispersion medium, and a process for polymerizing the polymerizable monomer composition after the formation of the droplets. After the process for polymerizing, a washing process and a drying process for formed colored polymer particles and other processes follow.

In the process for polymerizing, colored polymer particles are formed by polymerizing a polymerizable monomer composition in an aqueous dispersion medium; and, core-shell structure colored polymer particles can also be formed, as desired, by adding a step for further polymerizing the polymerizable monomer for shell in the presence of the colored polymer particles. As the aqueous dispersion medium, water, such as ion-exchanged water, can be used; and, a hydrophilic solvent such as an alcohol can also be added, as desired. In the aqueous dispersion medium, a dispersion stabilizer can be added to enhance the dispersion stability of the droplets of the polymerizable monomer composition. The aqueous dispersion medium is generally used also as the medium for the dispersion in the process for forming fine droplets.

The polymerizable monomer composition can contain various additives, such as a charge control agent, a release agent, a cross-linking monomer, a macromonomer, a molecular-weight controlling agent, a lubricant, and dispersion aids, as required.

(1) Polymerizable Monomer

In the present invention, a monovinyl monomer is generally used as the main component of the polymerizable monomer. Examples of monovinyl monomers include aromatic vinyl monomers such as styrene, vinyl toluene, and α-methyl styrene; acrylic acid and methacrylic acid; derivatives of acrylic acid or methacrylic acid such as methyl acrylate, methyl methacrylate, ethyl acrylate, ethyl methacrylate, propyl acrylate, propyl methacrylate, butyl acrylate, butyl methacrylate, 2-ethylhexyl acrylate, 2-ethylhexyl methacrylate, cyclohexyl acrylate, cyclohexyl methacrylate, isobonyl acrylate, isobonyl methacrylate, dimethylaminoethyl acrylate, dimethylaminoethyl methacrylate, acrylamide and methacrylamide; and monoolefin monomers such as ethylene, propylene, and butylene.

Monovinyl monomers can be used alone, or in a combination of two or more monomers. Among these monovinyl monomers, an aromatic vinyl monomer alone, the combination of an aromatic vinyl monomer, a derivative of acrylic acid and a derivative of methacrylic acid, or the like are preferably used.

If a cross-linking monomer or a cross-linking polymer is used together with a monovinyl monomer, hot-offset properties can be improved. A cross-linking monomer is a monomer having two or more vinyl groups. The specific examples thereof include aromatic divinyl compounds such as divinylbenzene, divinylnaphthalene, and the derivatives thereof; diethylenic unsaturated carbonic esters such as ethylene glycol dimethacrylate, diethylene glycol dimethacrylate, and 1,4-butanediol diacrylate; compounds having two vinyl groups such as N,N-divinylaniline and divinyl ether; and compounds having three or more vinyl groups such as pentaerythritol triallyl ethers and trimethylol propane triacrylate.

A cross-linking polymer is a polymer having two or more vinyl groups in the polymer. The specific examples thereof include esterified compounds obtained by the condensation reaction of: a polymer having two or more hydroxyl groups in a molecule, such as modified polyethylene, modified polypropylene, modified polyesters, and modified or non-modified polyethylene glycol; and an unsaturated carbonic acid monomer, such as acrylic acid and methacrylic acid.

These cross-linking monomers and cross-linking polymers can be used alone, or in a combination thereof. Their proportion used relative to 100 parts by weight of the monovinyl monomer is generally 10 parts by weight or less, preferably 0.01 to 7 parts by weight, more preferably 0.05 to 5 parts by weight, and most preferably 0.1 to 3 parts by weight.

The use of a macromonomer together with the monovinyl monomer is preferable because the balance of the shelf stability at high temperatures and the fixation properties at low temperatures becomes better. The macromonomer is a giant molecule having polymerizable unsaturated carbon-carbon double bonds at the terminals of the molecular chain, and is an oligomer or polymer generally having a number-average molecular weight of 1,000 to 30,000. The number-average molecular weight within the above described range is preferable because the fixation properties and shelf stability of the polymerized toner can be kept without lowering the melting properties of the macromonomer.

The preferable groups having a polymerizable unsaturated carbon-carbon double bond present at the terminal of the molecular chain of the macromonomer include the acroyl group and the methacroyl group, among which the methacroyl group is preferable from the point of view of the ease of co-polymerization with the monovinyl monomer used. The macromonomer that provides a polymer, by polymerizing alone, having a glass transition temperature higher than the glass transition temperature of a polymer obtained by polymerizing the monovinyl monomer used is preferable.

Specific examples of macromonomers include polymers formed by polymerizing of styrene, styrene derivatives, methacrylic ester, acrylic ester, acryronitrile, methacrylonitrile, and the like, alone or in a combination thereof; and macromonomers having polysiloxane skeletons. Among these, hydrophilic macromonomers are preferable, and polymers formed by polymerizing methacrylic ester alone, acrylic ester alone and in a combination thereof are especially preferable.

When a macromonomer is used, its portion used relative to 100 parts by weight of the monovinyl monomer is generally 0.01 to 10 parts by weight, preferably 0.03 to 5 parts by weight, and more preferably 0.05 to 1 part by weight. The portion of the macromonomer within the above described range is preferable because the shelf stability of the polymerized toner are kept, while the fixation properties are improved.

(2) Colorant

Various pigments and dyes used in the field of toners, such as carbon black and titanium white, can be used as the colorant. Examples of black colorants include pigments and dyes based on carbon black or nigrosin; and magnetic particles such as cobalt, nickel, triiron tetroxide, iron manganese oxide, iron zinc oxide, and iron nickel oxide. When carbon black is used, the use of carbon black having a primary particle diameter of 20 to 40 nm is preferable, because a favorable image quality is obtained, and the safety of the toner to the environment is increased. As colorants for color toners, a yellow colorant, magenta colorant, cyan colorant and the like can be used.

As yellow colorants, condensed azo compounds, isoindolinone compounds, anthraquinone compounds, azo metal complexes, methine compounds, allylamide compounds, and the like can be used. The specific examples include C. I. Pigment Yellow 3, 12, 13, 14, 15, 17, 62, 65, 73, 74, 83, 90, 93, 95, 96, 97, 109, 110, 111, 120, 128, 129, 138, 147, 155, 168, 180, and 181. In addition, Naphthol Yellow S, Hanza Yellow G, C. I. Vat Yellow, and the like are also included.

Examples of magenta colorants include condensed azo compounds, diketopyrrolopyrrole compounds, anthraquinone compounds, quinacridone compounds, basic dye lake compounds, naphthole compounds, benzimidazolone compounds, thioindigo compounds, and perylene compounds. The specific examples include C. I. Pigment Red 2, 3, 5, 6, 7, 23, 39, 48, 48:2, 48:3, 48:4, 57, 57:1, 58, 60, 63, 64, 68, 81, 81:1, 83, 87, 88, 89, 90, 112, 114, 122, 123, 144, 146, 149, 150, 163, 166, 169, 170, 177, 184, 185, 187, 202, 206, 207, 209, 220, 251, and 254. In addition, C. I. Pigment Violet 19 and the like are also included.

Examples of cyan colorants include copper phthalocyanine compounds and the derivatives thereof, anthraquinone compounds, and basic dye lake compounds. Specific examples include C. I. Pigment Blue 1, 2, 3, 6, 7, 15, 15:1, 15:2, 15:3, 15:4, 16, 17, 60, 62, and 66. In addition, phtharocyanine blue, C. I. Vat Blue, and C. I. Acid Blue are also included.

These colorants can be used alone, or in a combination of two or more. The proportion of the colorants to 100 parts by weight of the polymerizable monomer is generally 0.1 to 50 parts by weight, and preferably 1 to 20 parts by weight.

(3) Charge Control Agent

In order to improve the electrostatic properties of polymerized toners, it is preferable that the polymerizable monomer composition contains one or more of various charge control agents to positive or negative charge control agents. Examples of charge control agents include metal complexes of organic compounds having carboxyl groups or nitrogen-containing groups, metal-containing dyes, nigrosin, and charge control resins.

Specific examples of charge control agents include charge control agents such as Bontron N-01 (manufactured by Orient Chemical Industries, Ltd.), Nigrosin Base EX (manufactured by Orient Chemical Industries, Ltd.), Spiron Black TRH (manufactured by Hodogaya Chemical Co. Ltd.), T-77 (manufactured by Hodogaya Chemical Co. Ltd.), Bontron S-34 (manufactured by Orient Chemical Industries, Ltd.), Bontron E-81 (manufactured by Orient Chemical Industries, Ltd.), Bontron E-84 (manufactured by Orient Chemical Industries, Ltd.), Bontron E-89 (manufactured by Orient Chemical Industries, Ltd.), Bontron F-21 (manufactured by Orient Chemical Industries, Ltd.), COPY CHARGE NX VP434 (manufactured by Clariant), COPY CHARGE NEG VP2036 (manufactured by Clariant), TNS-4-1 (manufactured by Hodogaya Chemical Co. Ltd.), TNS-4-2 (manufactured by Hodogaya Chemical Co. Ltd.), LR-147 (manufactured by Japan Carlit), and Copy Blue PR (manufactured by Clariant); and charge control resins such as quaternary ammonium (salt) group-containing copolymers and sulfonic acid (salt) group-containing copolymers. The proportion of the charge control agent to 100 parts by weight of the polymerizable monomer is generally 0.01 to 10 parts by weight, and more preferably 0.1 to 10 parts by weight.

(4) Release Agent

In order to prevent offset or to improve the release property on hot-roll fixation, the polymerizable monomer composition may contain a release agent. Examples of release agents include polyolefin waxes, such as low-molecular-weight polyethylene, low-molecular-weight polypropylene, and low-molecular-weight polybutylene; natural vegetable waxes, such as candelilla, carnauba, rice, wood wax, and jojoba; petroleum-based waxes, such as paraffin, microcryatalline, and petrolactum, and modified wax thereof; synthetic waxes, such as Fischer Tropsch wax; and multifunctional ester compounds such as pentaerythritol tetramyristate, pentaerythritol tetrapalmitate, and dipentaerythritol hexamyristate. These release agents can be used alone, or in a combination of two or more.

Among these release agents, synthetic waxes, end-group modified polyolefin waxes, petroleum-based waxes, and multifunctional ester compounds are preferable. The proportion of the release agent to 100 parts by weight of the polymerizable monomer is generally 0.1 to 50 parts by weight, more preferably 0.5 to 20 parts by weight, and more preferably 1 to 10 parts by weight.

(5) Polymerization Initiator

Examples of polymerization initiators for polymerizable monomers include: persulfates such as potassium persulfate and ammonium persulfate; azo compounds such as 4,4'-azobis (4-cyanovaleric acid), 2,2'-azobis{2-methyl-N-(2-hydroxyethyl)propionamide}, 2,2'-azobis(2-amidinopropane) dihydrochloride, 2,2'-azobis(2,4-dimethylvaleronitrile), 2,2'-azobisisobutyronitrile, and 2,2'-azobis(2-methylpropionate); and peroxides such as di-t-butyl peroxide, dicumyl peroxide, lauroyl peroxide, benzoyl peroxide, t-butyl peroxy-2-ethylhexanoate, t-hexyl peroxy-2-ethylhexanoate, t-butyl peroxy pivalate, di-isopropyl peroxy dicarbonate, di-t-butyl peroxy isophthalate, 1,1',3,3'-tetramethylbutyl peroxy-2-ethylhexanoate, and t-butyl peroxy isobutylate. Redox initiators prepared by combining these polymerization initiators and reducing agents can also be used.

Among these initiators, it is preferable to select oil-soluble polymerization initiators soluble to the polymerizable monomer used. A water-soluble polymerization initiator can be used together as required. The polymerization initiator is used in the proportion of generally 0.1 to 20 parts by weight, preferably 0.3 to 15 parts by weight and more preferably 0.5 to 10 parts by weight, to 100 parts by weight of the polymerizable monomer.

The polymerization initiator can be added to the polymerizable monomer composition in advance; however, in order to prevent premature polymerization, the polymerization initiator can also be added directly into the suspension, after the completion of the step for forming the droplets of the polymerizable monomer composition, or during the polymerization reaction.

(6) Molecular-Weight Control Agent

It is preferable to use a molecular weight control agent during polymerization reaction. Examples of molecular weight control agents include: mercaptans such as t-dodecyl mercaptan, n-dodecyl mercaptan, n-octyl mercaptan, and 2,2,4,6,6-pentamethylheptane-4-thiol; and halogenated hydrocarbons such as carbon tetrachloride and carbon tetrabromide. Although the molecular weight control agent is generally contained in the polymerizable monomer composition before initiating polymerization, it can also be added during polymerization. The molecular weight control agent is used in the proportion of generally 0.01 to 10 parts by weight, preferably 0.1 to 5 parts by weight, to 100 parts by weight of the polymerizable monomer used.

(7) Dispersion Stabilizer

The colloid of a hardly-soluble metal compound is preferably used as the dispersion stabilizer in the present invention. Examples of hardly-soluble metal compounds include: sulfates such as barium sulfate and calcium sulfate; carbonates such as barium carbonate, calcium carbonate, and magnesium carbonate; phosphates such as calcium phosphate; metal oxides such as aluminum oxide and titanium oxide; and metal hydroxides such as aluminum hydroxide, magnesium hydroxide, and iron (III) hydroxide. Among these, the colloid of a hardly-soluble metal hydroxide is preferable since it can narrow the particle diameter distribution of polymer particles, and the sharpness of images is improved.

Although the forming way of the colloid of a hardly-soluble metal hydroxide is not limited to a specific way, it is preferable to use one obtained from the aqueous solution of a water-soluble multivalent metal compound after controlling the pH to 7 or more, and one obtained by a reaction of a water-soluble multivalent metal compound and an alkali metal hydroxide in an aqueous phase is more preferable as the colloid of the hardly-soluble metal compound. It is preferable that the number particle diameter distribution D50 (50% cumulative value of number particle diameter distribution) of the colloid of the hardly-soluble metal compound is 0.5 μm or less, and D90 (90% cumulative value of number particle diameter distribution) is 1 μm or less.

The dispersion stabilizer is used in the proportion of generally 0.1 to 20 parts by weight to 100 parts by weight of the polymerizable monomer. If the proportion is too small, sufficient polymerization stability is difficult to achieve, and polymerization aggregations are easily formed. On the contrary, if the proportion is too large, the viscosity of the aqueous solution becomes too high, and polymerization stability is lowered.

In the present invention, other dispersion stabilizers such as a water-soluble polymer can also be used as required. Examples of water-soluble polymers include polyvinyl alcohol, methylcellulose, and gelatin. In the present invention, although the use of a surfactant is not required, it can be used for stable conduct of suspension polymerization as long as the environment dependence of electrostatic properties of the resultant toner is not enlarged.

2. Process for Forming Fine Droplets

In order to manufacture a polymerized toner, a polymerizable monomer, a colorant, and other additives are mixed using a mixer, and as required, the materials are wet-ground using a media-type wet-grinding machine (e.g., beads mill) or the like, to prepare a polymerizable monomer composition. The polymerizable monomer composition and the aqueous dispersion medium are provided into a dispersion supply tank of an agitating apparatus. These may be provided separately, or preferably together after forming the blend thereof. In this invention the "blend" means the blend (or mixture) of the polymerizable monomer composition, the aqueous dispersion medium, and other optional additives. In case these are provided separately the blend is formed in the dispersion supply tank. The blend is preferably agitated in advance of providing into the dispersion supply tank or in the dispersion supply tank, to have the polymerizable monomer composition dispersed coarsely in the aqueous dispersion medium. In this case, the blend may be referred as a "coarse dispersion," and the state of the polymerizable monomer composition may be referred as "coarse droplets" or "primary droplets." The polymerizable monomer composition is dispersed in an aqueous dispersion medium preferably containing a dispersion stabilizer, and agitated to form uniform coarse (primary) droplets of the polymerizable monomer composition (primary droplets having a volume average particle diameter of 50 to 1,000 μm). The polymerization initiator is preferably added in the aqueous dispersion medium after the diameter of the primary droplets has become uniform in the aqueous dispersion medium to avoid premature polymerization.

When a pigment for colored toners is used as a colorant, and a charge control resin is used as a charge control agent, a pigment master batch may be preferably prepared by kneading the pigment and the charge control resin, in advance, and added to the polymerizable monomer composition.

The polymerization initiator is added and mixed to the blend, and agitated using an agitating apparatus to obtain fine droplets with a particle diameter of close to the particle diameter of the polymerized toner particles.

The volume average particle diameter and the particle diameter distribution of the fine droplets of the polymerizable monomer composition influence the average particle diameter and the particle diameter distribution of the polymerized toner. If the particle diameter of the fine droplets is too large, the average particle diameter of the resulting polymerized toner (colored polymer particles) will become too large and tend to cause lowering the resolution of the images. If the particle diameter distribution is wide, the particle diameter distribution of the resulting polymerized toner will become wide and tend to cause the fixation temperature to fluctuate, and resulting in troubles such as the occurrence of fog and toner filming. Therefore, it is desired to form the droplets of the polymerizable monomer composition having substantially the same diameter as the diameter of the polymerized toner particles.

In the present invention, particle diameter Dv 50 (μm), wherein the cumulative total volume calculated from the small particle diameter side of the polymerizable monomer composition is 50%, is used as the volume average particle diameter of the droplets of the polymerizable monomer composition. The particle diameter Dv 50 of the droplets (hereinafter referred as "droplet particle diameter Dv" if possible) can be measured using, for example, an SALD particle diameter distribution measuring instrument (manufactured by Shimadzu Corporation).

The droplet particle diameter Dv of the polymerizable monomer composition is preferably 3 to 10 μm, more preferably 4 to 9 μm, and further more preferably 4 to 8 μm. In order to obtain highly fine images, the polymerized toner of a small particle diameter is effective, and for this purpose, it is desirable to lessen the droplet particle diameter Dv. The particle diameter distribution of the droplets of the polymerizable monomer composition (volume average particle diameter/number average particle diameter) is preferably 1 to 2, and more preferably 1 to 1.5.

As the manner for controlling the droplet particle diameter Dv of the polymerizable monomer composition, a manner for controlling the proportion of the dispersion stabilizer, such as a colloid of a hardly water-soluble metal hydroxide, is generally adopted. However, the droplet particle diameter Dv also varies depending on the agitating conditions of the dispersion, and the like. Therefore, it is desirable that the proportion of the dispersion stabilizer is controlled first so as to obtain nearly desired droplet particle diameter Dv, and then the agitating conditions and the like are controlled so as to precisely control the droplet particle diameter Dv.

The present invention adopts a process for forming fine droplets comprising the steps of:

- preparing an agitating apparatus having
  - an agitator equipped with an agitating blade or rotor and
  - a dispersion supply tank;
- providing a polymerizable monomer composition and an aqueous dispersion medium into the dispersion supply tank; then,
- mixing the polymerizable monomer composition and the aqueous dispersion medium by the agitator to obtain a dispersion of fine droplets;
- optionally, feeding back the dispersion into the dispersion supply tank and circulating the dispersion; and
- providing the dispersion to the process for polymerizing.

Examples of agitators used for forming droplets include: (i) a dispersing machine having the combination of a rotor and a stator that are concentric comb-teeth ring, which is constituted so as to drive the rotor to rotate at a high speed to flow the blend from the inside of the rotor to the outside of the stator, and to agitate the blend in the gap between the rotor and the stator, such as a multi-stage inline classifier manufactured by IKA GmbH of Germany, and Ebara Milder manufactured by Ebara Corporation; (ii) an agitator to form droplets by the actions of shearing force, collision force, pressure fluctuation, cavitations, and potential cores, generated between the rotor rotating at a high speed and a screen surrounding the rotor, such as Clearmix CLM-0.8S manufactured by MTECHNIQUE Co., Ltd.; and (iii) an agitator to form fine droplets by compressing the dispersion to the internal wall of the tank with a centrifugal force, to form a liquid film, and to touch said liquid film with the edges of the agitating blade or rotor rotating at an ultra-high speed, such as TK Homo Mixer manufactured by Tokushu Kika Kogyo Co., Ltd.

Among these agitators, dispersing machines such as a multi-stage inline classifier manufactured by IKA GmbH of Germany, and Ebara Milder manufactured by Ebara Corporation are preferable. These dispersing machines include vertical and horizontal machines. Among horizontal dispersing machines (trade name "Cavitron", manufactured by Eurotec Ltd.) is preferable. In this invention "rotor or agitator" includes rotor and agitator, and is rotor when the agitator is a dispersing machine having a rotor.

Figure 2:
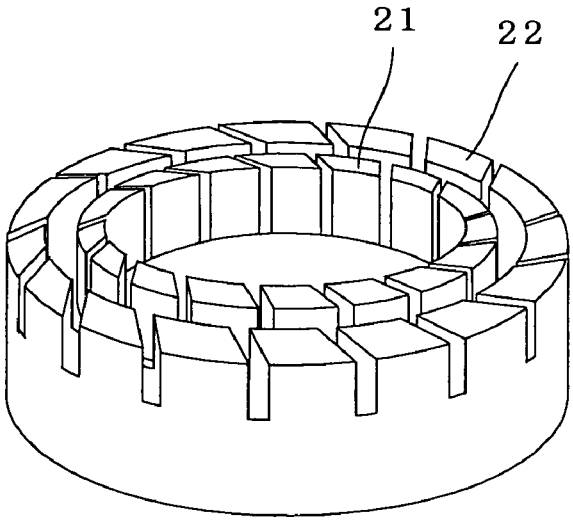
FIG. 2 is a schematic diagram illustrating the structures of a rotor and a stator in the agitator of the agitating apparatus shown in FIG. 1.

FIG. 1 shows a schematic diagram of an agitating apparatus, and number 1 of FIG. 1 shows a sectional view of an example of vertical multi-stage inline dispersing machine as a sample of agitator. Specifically, the dispersing machine has the combinations of rotors 4, 6 and 8, and stators 3, 5 and 7, which are concentric comb-teeth rings, and is constituted so that an agitation shaft 9 drives the rotors to rotate at a high speed, to flow the coarse dispersion (the blend) from the inside of the rotors to the outside of the stators, and to agitate the coarse dispersion in the gaps between the rotors and the stators. This dispersing machine has layers, each having a rotor and a stator (1st layer: 3+4; 2nd layer: 5+6, 3rd layer; 7+8). In general, the number of the layer is one or more than one. In this dispersing machine, one stage or more, in many cases, two or more stages of combinations are arranged, each combination having a rotor and a stator. Here a "stage" means a combination of a bump and a dimple forming the gap between the rotor and the stator. FIG. 2 shows a diagram illustrating the case where one layer of a rotor 21 and one layer of a stator 22 are used.

Examples of the combinations of rotors and stators include a 3-stage structure of coarse teeth/medium teeth (or fine teeth)/medium teeth (or fine teeth), a 2-stage structure of coarse teeth/medium teeth (or fine teeth), and a 1-stage structure of coarse teeth, medium teeth or fine teeth, among which the 3-stage structure is preferable.

The coarse dispersion is supplied from the dispersion supply tank 12 through the line 13 into the dispersing machine 1. Ways for transferring the coarse dispersion is not specifically limited, and a way using a liquid pump can be used. The coarse dispersion is supplied into the dispersing machine through an inner nozzle (not shown). The rotors are rotated at a high speed, to flow the coarse dispersion (the blend) from the inside of the rotors to the outside of the stators, and to agitate it in the gaps between the rotors and the stators.

Optionally, the dispersion agitated in the dispersing machine 1 is fed back from the outlet port 10 through the line 11 into the dispersing machine 1 for circulation. The internal pressure of the dispersing machine can be controlled, for example, by narrowing down the flow rate at the outlet port 10. The internal pressure of the dispersing machine is controlled into the range of preferably 0.01 to 15 MPa, more preferably 0.05 to 10 MPa, and further more preferably 0.1 to 5 MPa. By controlling the internal pressure of the dispersing machine within the above described ranges, fine droplets can be efficiently formed while inhibiting foaming due to cavitation. After forming the fine droplets, the dispersion is supplied to a polymerization reactor, the process for polymerizing, through the liquid-transfer line 14.

In the present invention, the agitator is controlled so that R/θ is 2 or more, and R is 30 m/s or more, wherein the peripheral velocity (m/s) of the agitating blade or rotor of the agitator is denoted by R, and the number of circulations represented by {throughput of the dispersion (liter/h)×agitating time (h)}/{providing rate of the polymerizable monomer composition and the aqueous dispersion medium (liter)} is denoted by θ.

Here, the peripheral velocity of the agitating blades or rotors means the tip speed of the agitating blades or rotors. The number of circulations θ means the number of circulations of the dispersion in the dispersing machine. In other words, by multiplying the throughput of the dispersion in the dispersing machine (liter/h) by the agitating time by the dispersing machine (h), the total quantity agitated in the dispersing machine can be calculated. When the total quantity agitated is divided by the provided quantity of the polymerizable monomer composition and the aqueous dispersion medium (liter), the number of circulations (θ) of the dispersion can be calculated.

In the present invention, process conditions are controlled so that R/θ is 2 or more, preferably 3 or more, and more preferably 5 or more. If the R/θ is too low, the content of fine powder cannot be reduced, and the particle diameter distribution of obtained colored polymer particles (polymerized toner) may not be sharpened sufficiently. Although there is no specific upper limit of R/θ, it is preferably 100, more preferably 60, and further more preferably 40, from the point of view of the functions of the dispersing machine and the like.

In order to make R/θ 2 or more, for example, a way to increase the peripheral velocity (m/s) of the agitating blades or rotors (hereinafter represented by "rotors") of the agitator is effective. The peripheral velocity of the rotors is set in the range of 30 m/s or more, and preferably between 30 and 100 m/s. Conventionally, the peripheral velocity of the rotors has been set in the range of 35 m/s or below; whereas in the method of the present invention, the peripheral velocity of the rotors is preferably more than 35 m/s, and it is desirable to select the type of dispersing machines that can be operated at such a high peripheral velocity. The peripheral velocity of the rotors is particularly preferably 40 m/s or higher. Examples of dispersing machines that can be operated at such a high peripheral velocity include vertical dispersing machines Module DRS 2000 Series manufactured by IKA GmbH, and horizontal dispersing machines Cavitron manufactured by Eurotec, Ltd.

Since increase in the peripheral velocity of the rotors makes the formation of the droplets of the polymerizable monomer composition extremely efficient, the number of circulations θ of the dispersion in the dispersing machine can be minimized, whereby R/θ can be increased. When the droplet particle diameter Dv is preferably, for example, 7 μm or more, and more preferably 8 μm or more, the number of circulations θ can be preferably 2 or less, and more preferably 1 (one pass). Although there is no specific upper limit of the number of circulations θ, it is preferably 20, and more preferably about 15.

The smaller droplet particle diameter Dv is, the larger R/θ becomes. On the other hand, if the droplet particle diameter Dv is small, the number of circulations θ in the dispersing machine must be generally increased. The volume average particle diameter dv of the colored polymer particles obtained after polymerization is substantially proportional to the droplet particle diameter Dv of the polymerizable monomer composition, and is slightly larger than the droplet particle diameter Dv. It is desirable to control the droplet particle diameter Dv of the polymerizable monomer composition within a range preferably 3-9 μm, more preferably 3.5-8 μm, and most preferably 4-7 μm. Therefore, the method of the present invention is particularly suitable as the method for manufacturing a polymerized toner having a small average particle diameter.

According to the method of the present invention, colored polymer particles (polymerized toner) having: a volume average particle diameter dv of preferably 4-9 μm; and a ratio dv/dp, of a volume average particle diameter dv to a number average particle diameter dp, of preferably 1.25 or less, more preferably 1.20 or less, and further more preferably 1.15 or less; can be manufactured. In addition, the colored polymer particles, obtained by the method of the present invention, has the number percentage, of the particle diameter of 3 μm or smaller, of preferably 8% or less, more preferably 7% or less, and further more preferably 6% or less; and the proportion of fine powder is remarkably reduced even if the volume average particle diameter is small. The number percentage, of the particle diameter of 5 μm or smaller, varies depending on the volume average particle diameter dv, and has larger values as the volume average particle diameter dv approaches 5 μm.

3. Process for Polymerizing

Suspension polymerization and emulsion polymerization can be adopted as the polymerizing manner. In the present invention, suspension polymerization is preferable. The polymerizing step is described below, referring mainly to suspension polymerization.

The dispersion, containing fine droplets, formed by the above described process, is provided into a polymerization reactor, and suspension polymerization is performed at a temperature of generally 5 to 120° C., and preferably 35 to 95° C. If the polymerization temperature is too low, a polymerization initiator having a high catalytic activity must be used, and the polymerization reaction becomes difficult to control. If the polymerization temperature is too high, when additives that melt at a low temperature are used, the additives bleed on the surface of the polymerized toner, and the shelf stability thereof tends to be degraded.

One or more of the above described monovinyl monomers are selected as the polymerizable monomer. In order to lower the fixation temperature of the toner, it is preferable to select a polymerizable monomer or a combination of polymerizable monomers, that form a polymer, by polymerization thereof alone, with a glass transition temperature (Tg) of 80° C. or below, preferably 40 to 80° C., and more preferably 50 to 70° C. In the present invention, when a copolymer is used as the binder resin, the Tg of the copolymer is the calculated value (referred as "calculated Tg"), calculated corresponding to the type and the proportion of the polymerizable monomers used.

By polymerization, colored polymer particles, wherein additive components such as a colorant are dispersed in the polymerized product of polymerizable monomers, are formed. In the present invention, these colored polymer particles can be used as a polymerized toner as they are; and they are also used as a capsule toner, having a core-shell structure formed by further forming a polymer layer on them, for the purpose of improving the shelf stability (anti-blocking properties), low-temperature fixation properties, and melting properties in fixation.

As a manner for forming the core-shell structure, the method is used, wherein the above described colored polymer particles are used as core particles, and another polymerizable monomer (or monomers) for shell is added and further polymerized in the presence of the core particles, to form a polymer layer (shell) on the surface of core particles. If a polymerizable monomer, that form a polymer, by polymerization thereof alone, a polymer having the Tg higher than the Tg of the polymer component composing the core particles, is used as the polymerizable monomer for the shell, the shelf stability of the resulting polymerized toner can be improved. On the other hand, by setting the Tg of the polymer components composing the core particles lower, the fixation temperature of the polymerized toner can be lowered, and the melting properties can be improved. Therefore, by forming polymer particles of a core-shell structure in the process for polymerizing, a polymerized toner, materializing high-speed printing (copying, printing and the like), full-color printing, and OHP (overhead projector) transmission properties, can be obtained.

As the polymerizable monomer for forming core and shell, a preferable monomer can be selected from the above described monovinyl monomers. The weight ratio of the polymerizable monomer for the core to the polymerizable monomer for the shell is generally 40/60 to 99.9/0.1, and preferably 60/40 to 99.7/0.3, and more preferably 80/20 to 99.5/0.5. If the proportion of the polymerizable monomer for the shell is too small, the effect of improving the shelf stability of the polymerized toner becomes small; and if the proportion is too large, the effect of lowering fixation temperature becomes small.

The Tg of the polymer formed from the polymerizable monomer for the shell alone is generally above 50° C. and 120° C. or below, preferably above 60° C. and 110° C. or below, and more preferably above 80° C. and 105° C. or below. Difference between the Tg of the polymer formed from the polymerizable monomer for the core alone and the Tg of the polymer formed from the polymerizable monomer for the shell alone is preferably 10 degrees or more, more preferably 20 degrees or more, and further preferably 30 degrees or more. In many cases, it is preferable to select the polymerizable monomer for the core that can form the polymer having a Tg of generally 60° C. or below, preferably between 40° C. and 60° C., from the point of view of the balance between fixation temperatures and shelf stability. On the other hand, it is preferable to use the polymerizable monomer for the shell, such as styrene and methyl methacrylate that can form the polymer having a Tg of 80° C. or above alone or in a combination of two or more.

A charge control agent can be added to the polymerizable monomer for the shell. The preferable charge control agents are the same as the charge control agents listed above for forming of the core particles, and when used, the proportion of the charge control agent is generally 0.01 to 10 parts by weight, preferably 0.1 to 5 parts by weight, to 100 parts by weight of the polymerizable monomer for the shell.

When the polymerizable monomer for the shell is added, it is preferable to add a water-soluble radical initiator for efficiently forming the shell. Examples of water-soluble radical initiators include persulfates such as potassium persulfate and ammonium persulfate; and azo-based initiators such as 2,2'-azobis{2-methyl-N-(2-hydroxyethyl)propionamide} and 2,2'-azobis{2-methyl-N-(1,1-bis(hydroxymethyl)ethyl)propionamide}. The water-soluble polymerization initiator is used in the proportion of generally 0.1 to 50 parts by weight, and preferably 1 to 20 parts by weight, to 100 parts by weight of the polymerizable monomer for the shell.

The average thickness of the shell is generally 0.001 to 1.0 μm, preferably 0.003 to 0.5 μm and more preverably 0.005 to 0.2 μm. If the thickness of the shell is too large, the fixation properties of the polymerized toner are lowered; if it is too small, the shelf stability of the polymerized toner is lowered. If the core and the shell of the polymerized toner can be observed using an electron microscope, the core particle diameter and the thickness of the shell can be obtained by directly measuring the particle diameter and shell thickness of a particle randomly selected from the photographs; if it is difficult to observe the core and the shell using an electron microscope, the thickness of the shell can be calculated from the core particle diameter and the quantity of the polymerizable monomer used for forming the shell.

4. Process for Getting the Colored Polymer Particles

In the process for polymerizing, the dispersion containing an aqueous dispersion medium and the colored polymer particles (including the core-shell structure colored polymer particles) are obtained. In the process for getting the colored polymer particles, filtration, washing, drying and the like, are sequentially performed.

In filtering and washing step, the dispersion obtained in the process for polymerizing is used as it is, or ion-exchanged water or the like is added for adjusting the concentration of colored polymer particles, to form a dispersion containing colored polymer particles. In this stage, in order to solubilize and remove the dispersion stabilizer used, treatment such as acid washing and alkali washing may be performed depending on the kind of the dispersion stabilizer. For example, when a colloid of a hardly water-soluble metal hydroxide, such as magnesium hydroxide, is used as the dispersion stabilizer, the pH of the dispersion may be generally lowered to dissolve the colloid in an aqueous dispersion medium. During the colored polymer particles are in the state of the dispersion, monomer-removing treatment, such as stripping treatment, may also be performed. In order to adjust the particle diameter of the colored polymer particles, the colored polymer particles can be coagulated or aggregated.

The way for filtering and washing is not specifically limited, and for example, a method for filtering and washing the cake of colored polymer particles, using a vacuum belt filter, can optionally selected. After the washing step, the colored polymer particles in a wet state (wet cake) are obtained. The drying step of the colored polymer particles is performed by conventional drying treatment, and dried colored polymer particles are obtained.

The volume average particle diameter (dv) of the polymerized toner (including a capsule toner having a core-shell structure), obtained by the manufacturing method of the present invention, is not specifically limited, and it is generally 3 to 10 μm, preferably 4 to 9 μm, and more preferably 4 to 8 μm. To make the resolution higher to obtain highly fine images, it is preferable to lessen the volume average particle diameter of the toner to such a small particle diameter.

The particle diameter distribution of the polymerized toner, represented by {volume average particle diameter (dv)}/{number average particle diameter (dp)}, is generally 1.25 or less, preferably 1.20 or less, and more preferably 1.15 or less. If the volume average particle diameter of the polymerized toner is too large, the resolution tends to lower. If the particle diameter distribution of the polymerized toner is too large, the proportion of the toner of large particle diameter increases, and the resolution tends to lower.

In the polymerized toner of the present invention, the proportion of fine powder is reduced. More specifically, the number distribution, of a volume average particle diameter dv of 3 μm or less, is preferably 8% or less, more preferably 7% or less, and further more preferably 6% or less; the proportion of fine powder is remarkably reduced regardless of small volume average particle diameter.

It is preferable that the polymerized toner of the present invention has: a volume average particle diameter dv of 4 to 9 μm; a ratio, of the volume average particle diameter dv to the number average particle diameter dp, dv/dp, of 1.25 or less; and a number percentage, of particle diameter of 3 μm or smaller, of 8% or less.

It is preferable that the polymerized toner of the present invention is substantially spherical, and the sphericity, represented by the ratio of the major axis (d1) to the miner axis (ds), d1/ds, is preferably 1 to 1.3, and more preferably 1 to 1.2. The use of the substantially spherical polymerized toner, as a non-magnetic one-component developer, improves the transfer efficiency of the toner image on the photoconductive member to the transfer medium.

The polymerized toner of the present invention can be used as the toner component of various developers, and the use as a non-magnetic one-component developer is preferable. When the polymerized toner of the present invention is used as a non-magnetic one-component developer, external additives can be mixed, as required. Examples of the external additives include inorganic particles and organic resin particles acting as fluidizing agents or abrasives.

Examples of the inorganic particles include silicon dioxide (silica), aluminum oxide (alumina), titanium oxide, zinc oxide, tin oxide, barium titanate, and strontium titanate. Examples of the organic resin particles include methacrylic ester polymer particles, acrylic ester polymer particles, styrene-methacrylic ester copolymer particles, styrene-acrylic ester copolymer particles, and core-shell structure particles wherein the core is formed of a styrene polymer and the shell is formed of a methacrylic ester copolymer.

Among these, inorganic oxide particles are preferable, and silicon dioxide is especially preferable. The surface of inorganic particles can be subjected to hydrophobicizing treatment, and silicon dioxide particles subjected to hydrophobicizing treatment are especially preferable. Two or more external additives can be used in a combination, and when external additives are used in a combination, it is preferable to use the inorganic particles with different average particle diameter, or inorganic particles and organic resin particles in a combination. The proportion of the external additives is not specifically limited, and it is generally 0.1 to 6 parts by weight to 100 parts by weight of the polymerized toner. In order to make the external additive adhere to the polymerized toner, the polymerized toner and the external additive are generally agitated in a mixer such as a Henschel mixer.

The polymerized toner of the present invention: excels in printing density not only in a low-temperature, low-humidity environment but also in a high-temperature, high-humidity environment; causes little fog; has a high resolution; and excels in cleaning properties.

According to the present invention, there is provided a method for manufacturing a polymerized toner, wherein: a polymerized toner, that has a very sharp particle diameter distribution and an extremely small proportion of fine powder is manufactured efficiently; design of processes for manufacturing a polymerization toner with a desired average particle diameter is easy; the process for forming fine droplets is performed efficiently.

According to the method of the present invention, since the target particle diameter can be achieved very quickly in the process for forming fine droplets of the polymerizable monomer composition, a small agitating machine (such as a dispersing machine) can be used for operation. According to the method of the present invention, since the proportion of fine powder can be reduced remarkably, there is no need to classify and remove the fine powder.

EXAMPLES

The present invention is more specifically described below referring to Examples and Comparative Examples. In the following Examples and Comparative Examples, "part" and "%" are expressed on the basis of weight unless otherwise specified. The methods for evaluation are as the followings.

(1) Droplet Particle Diameter (Dv 50)

After forming the droplets (particle forming) of a polymerizable monomer composition in an aqueous dispersion medium, 1 ml of the droplets were sampled and dispersed in 30 ml of a 4% aqueous solution of sodium tetraborate, and ultrasonic waves of 125 W were radiated for 1 minute. The obtained dispersion was used as the sample, and the particle diameter of the droplets was measured using an SALD particle diameter distribution-measuring instrument (manufactured by Shimadzu Corporation). The diameter of the droplets is the particle diameter Dv 50 (unit: μm), which is the cumulative volume calculated from the small particle diameter side of 50%.

(2) Average Particle Diameter and Particle Diameter Distribution of Colored Polymer Particles (Polymerized Toner)

The volume average particle diameter (dv) of the colored polymer particles, the particle diameter distribution, i.e., the ratio (dv/dp) of the volume average particle diameter (dv) to the number average particle diameter (dp), the number percentage of 2 to 3 μm particles, and the number percentage of 2 to 5 μm particles were measured using Multisizer (manufactured by Beckman Coulter). The measurement using the Multisizer was conducted under the conditions of: aperture diameter=100 μm, medium=Isoton II, concentration=10%, and the number of measured particles=100,000.

(3) Printing Density

Sheets of copying paper were set in a commercially available printer of a non-magnetic single-component developing system (manufactured by Oki Data Corporation, trade-name "MICROLINE 3010C"), a toner to be tested (non-magnetic single-component developer) was provided in the developing unit. The printer was laid still for one day and night each, in an (L/L) environment of a temperature of 10° C. and a relative humidity of 20%, and in an (H/H) environment of a temperature of 35° C. and a relative humidity of 80%. Thereafter, in each environment, continuous printing at 5% density was performed from the beginning. After 20,000 sheets of the continuous printing has completed, solid printing was performed, and the printing density on the printed area of the solid printing was measured using a color reflection-type density meter (manufactured by X-rite, model name "404A")

(4) Fog

Sheets of copying paper were set, a toner to be tested was provided, the printer was laid still in the same manners as in the test (3). Thereafter, in each of L/L and H/H environment, continuous printing at 5% density was performed from the beginning. After 20,000 sheets of continuous printing has completed, white solid printing was performed, and printing was stopped halfway of the white printing. The toner on non-image area, present on the photoconductive member after development, was peeled off using an adhesive tape (Scotch Mending Tape 810-3-18, manufactured by Sumitomo 3M) and the adhesive tape was stuck to a new sheet of copying paper. The color tone of this paper was measured using a spectrocolorimeter (whiteness mater, manufactured by Nippon Denshoku Industries, Ltd.) and expressed as the coordinate of the "Lab" space, and color difference ΔE was calculated and denoted as the fog value. The smaller value indicates the less fog.

(5) Cleaning Properties

A toner was provided in the developing unit of the same printer in the same manners as in the test (3), the continuous printing was performed from the beginning to 20,000 sheets. The photoconductive member and the charging roll were observed every 1,000 sheets of printing, and the number of sheets having streaks started due to defective cleaning was counted.

(6) Resolution

After the continuous printing of 20,000 was performed from the beginning in the same manner as in the test (3), a 1-dot line and a 1-dot white line, and a 2-dot line and a 2-dot white line were printed, the reproducibility of these lines was observed using an optical microscope, and evaluated on the following criteria.

A: The 1-dot line and 1-dot white line are reproduced.

B: Although the 1-dot line and 1-dot white line are not reproduced, the 2-dot line and 2-dot white line are reproduced.

C: Neither the 2-dot line nor 2-dot white line are reproduced.

Example 1

1. Preparation of Colorant Master Batch

To 100 parts of a charge control resin (weight average molecular weight=20,000, glass transition temperature Tg=62° C.) obtained by copolymerizing 82% of styrene, 11% of butyl acrylate and 7% of 2-acrylamide-2-methylpropane sulfonic acid, 24 parts of methyl ethyl ketone and 6 parts of methanol are dispersed, and the resulting resin mixture was kneaded using roll machine with cooling. When the resin mixture was winded on the rolls, 100 parts by weight of a magenta pigment (manufactured by Client Co., trade name: Toner Magenta E02, Pigment Red 122) was added gradually, the resultant mixture was kneaded for 1 hour to obtain a charge control resin composition (a colorant master batch). At this time, the clearance between the rolls was initially 1 mm, and thereafter broadened gradually to 3 mm at end, and an organic solvent (mixed solvent of methyl ethyl ketone/methanol=4/1) was added occasionally according to mixing condition of the charge control resin composition. The added organic solvent was eliminated under reduced pressure after mixing was over.

2. Preparation of Polymerizable Monomer Composition for Core

Separately, 80 parts of styrene, 20 parts of n-butyl acrylate, 0.6 part of divinyl benzene and 0.25 part of polymethacrylic ester macromonomer (manufactured by Toagosei Co., Ltd., trade name: "AA6", Tg=94° C.), 12 parts of the above described charge control resin composition, 1 part of t-dodecyl mercaptan, and 10 parts of pentaerythritol hexamyristate were dispersed using a beads mill to obtain a polymerizable monomer composition for core.

3. Preparation of Aqueous Dispersion Medium

Separately, in a vessel (agitating tank) having agitating blades equipped, an aqueous solution of 17.0 parts of magnesium chloride dissolved in 230 parts of ion-exchanged water is provided, and an aqueous solution of 10.3 parts of sodium hydroxide dissolved in 50 parts of ion-exchanged water is added gradually during stirring, to obtain a dispersion of magnesium hydroxide colloid. The particle diameter distribution of the formed colloid was measured using an SALD particle diameter distribution measuring instrument (manufactured by Shimadzu Corporation), the particle diameter Dp 50, wherein cumulative number calculated from the small particle diameter side was 50%, was 0.35 μm, and the particle diameter Dp 90, wherein cumulative number calculated from the small particle diameter side was 90%, was 0.62 μm.

4. Preparation of Polymerizable Monomer for Shell

Two parts of methyl methacrylate and 65 parts of ion-exchanged water were mixed to obtain an aqueous coarse dispersion of a polymerizable monomer for shell. The primary droplets of the polymerizable monomer for shell had a Dp 90 of 1.6 μm.

5. Process for Forming Fine Droplets

The polymerizable monomer for core (prepared in the step 2) was poured into the dispersion of magnesium hydroxide colloid (prepared in the step 3), the mixture (the blend) was agitated until the droplets (primary droplets) become stable. Five (5) parts of t-butylperoxy-2-ethylhexanoate (manufactured by NOF, trade name: "Perbutyl O") was added to the blend. Then, the resultant mixture (blend) was agitated to form fine droplets of the polymerizable monomer composition according to the following process.

An agitating apparatus as in FIG. 1 was used. A vertical multi-stage inline dispersing machine "DRS 2000/5" (manufactured by IKA GmbH), having 3 stages of the combinations of rotors and stators which are concentric comb-teeth rings, as shown as No. 1 in FIG. 1, was used as the agitator. The comb-teeth rotors were rotated at a rotation speed of 13,400 rpm, and a tip speed (peripheral velocity) of the rotors of 40 m/s, and the internal pressure was kept to 0.1 MPa. The blend was provided into dispersion supply tank 12, and agitated with the agitator 1 to obtain a dispersion of fine droplets. The dispersion from the agitator 1 was fed back to the liquid phase of the dispersion supply tank 12 trough line 11, and agitated at a high speed for 4 minutes, while circulating by returning the dispersion at an ejecting speed of 0.5 m/s into the agitator 1 through the line 13 and inner nozzle, to form fine droplets of the polymerizable monomer composition. At this time, the tip of the inner nozzle was adjusted to locate at 50 mm below the level of the dispersion, in the agitator 1. The number of circulations θ of the dispersion was 5. A cooling jacket was mounted around the DRS 2000/5, and cooling water of about 15° C. was circulated in the cooling jacket. The quantity of the agitated dispersion was 3.9 liters. Dv 50 was measured as is test (1) and was 4.03 μm.

6. Process for Polymerizing

To the dispersion of magnesium hydroxide colloid wherein the fine droplets of the above described polymerizable monomer composition for cores were formed, 1 part of sodium tetraborate decahydrate was added, the resultant mixture was provided into a reactor equipped with agitating blades, and the polymerization reaction was initiated at 85° C. After the polymarization conversion rate reached at substantially 100%, 0.2 part of a water-soluble initiator (manufactured by Wako Pure Chemical Industries, Ltd., trade name: "VA-086", 2,2'-azobis {2-methyl-N(2-hydroxyethyl)-propionamide}) dissolved in the above described aqueous coarse dispersion of the polymerizable monomer for shell was provided into the reactor. After continuing further polymerization reaction for 4 hours, the polymerization reaction was stopped to obtain an aqueous dispersion of a core-shell structure colored polymer particles.

7. Post-Polymerization Process

While agitating, to the aqueous dispersion of the colored polymer particles, sulfuric acid was added to lower its pH to 4 or below by acid washing. After water was dehydrated by filtration, 500 parts of ion-exchanged water was added to form the slurry again, and washed with water. Thereafter, dehydration and washing with water were repeated for several times, the solid matter was separated by filtration, and dried in a dryer at 45° C. for 2 days and nights, to obtain core-shell structure colored polymer particles, of a volume average particle diameter (dv) of 5.39 μm, and a particle diameter distribution (dv/dp) of 1.11.

8. Preparation of Developer

To 100 parts of the above core-shell structure colored polymer particles, 0.5 part of silica having a hydrophobic degree of 65% and volume average particle diameter of 7 nm (manufactured by Nippon Aerosil Co., Ltd.; trade name: "RX-300"), 0.2 part of silica having hydrophobic degree of 64% and volume average particle diameter of 40 nm (manufactured by Nippon Aerosil Co., Ltd.; trade name: "RX-50"), and 0.3 part of cubic calcium carbonate having volume average particle diameter of 0.3 μm (manufactured by Maruo Calcium Co., Ltd.; trade name: "CUBE-03BHS") were added, and mixed using a Henschel mixer for 10 minutes at a rotating speed of 1,400 rpm to obtain non-magnetic single-component developer (toner) The results are shown in Table 1.

Example 2

Colored polymer particles were manufactured in the same manner as in Example 1, except that: 11.3 parts of magnesium chloride was used instead of 17.0 parts of magnesium chloride, 6.9 parts of sodium hydroxide was used instead of 10.3 parts of sodium hydroxide, in the step of "preparation of aqueous dispersion medium" in Example 1; and the process conditions were changed to as in Table 1, in the "process for forming fine droplets" in Example 1; to obtain a non-magnetic single-component developer. In the process for forming fine droplets, the droplets having a Dv 50 of 6.69 μm were formed. The results are shown in Table 1.

Comparative Example 1

Colored polymer particles were manufactured in the same manner as in Example 1, except that: 20.3 parts of magnesium chloride was used instead of 17.0 parts of magnesium chloride, 12.4 parts of sodium hydroxide was used instead of 10.3 parts of sodium hydroxide, in the step of "preparation of aqueous dispersion medium" in Example 1; the process conditions were changed to as in Table 1 using Ebara Milder "MDN303V" (manufactured by Ebara Corporation) in place of the multi-stage inline dispersing machine "DRS 2000/5", the quantity of the agitated dispersion was 2.0 liters, process was performed without internal pressure at the agitator, in the "process for forming fine droplets" in Example 1; to obtain a non-magnetic single-component developer. In the process for forming fine droplets, fine droplets having a Dv 50 of 4.28 μm were formed. The results are shown in Table 1.

Comparative Example 2

Colored polymer particles were manufactured in the same manner as in Example 1, except that the process conditions were changed to as in Table 1, to obtain a non-magnetic single-component developer. In the process for forming fine droplets, fine droplets having a Dv 50 of 4.88 μm were formed. The results are shown in Table 1.

TABLE 1

| | Example | | Comparative Example | |
|---|---|---|---|---|
| | 1 | 2 | 1 | 2 |
| Throughput of the dispersion (1/h) | 289 | 289 | 180 | 136 |
| Agitating time (sec) | 240 | 80 | 166 | 1030 |
| Number of circulations (θ) | 5 | 1.6 | 15 | 10 |
| Peripheral velocity R (m/s) | 40 | 40 | 23 | 27 |
| R/θ | 8.0 | 25.0 | 1.5 | 2.7 |
| Toner properties | | | | |
| Volume average particle diameter (μm) | 5.39 | 7.92 | 5.71 | 6.31 |
| ≦5 μm (number %) | 56.6 | 14.3 | 58.5 | 53.4 |
| ≦3 μm (number %) | 5.7 | 3.5 | 10.5 | 16.2 |
| dv/dp | 1.11 | 1.15 | 1.19 | 1.32 |
| Image evaluation | | | | |
| Printing density | | | | |
| H/H environment | 1.51 | 1.46 | 1.49 | 1.48 |
| L/L environment | 1.48 | 1.42 | 1.46 | 1.45 |
| Fog | | | | |
| H/H environment | 0.8 | 0.7 | 2.2 | 3.1 |
| L/L environment | 0.3 | 0.2 | 1.2 | 1.3 |
| Cleaning properties | ≧20,000 | ≧20,000 | 18000 | 12000 |
| Resolution | A | A | A | B |

INDUSTRIAL APPLICABILITY

The toner manufactured by the method of the present invention is useful as a toner, a developer, in image forming machines such as electrographic or electrostatic copying machines, laser-beam printers and facsimiles.

What is claimed is:

1. A method for manufacturing a polymerized toner comprising a process for forming fine droplets of a polymerizable monomer composition containing a polymerizable monomer and a colorant, in an aqueous dispersion medium, and a process for polymerizing the polymerizable monomer composition after the process for forming fine droplets; wherein, the process for forming fine droplets comprising the steps of:

step (1) preparing an agitating apparatus having an agitator equipped with an agitating blade or rotor and a dispersion supply tank, said dispersion supply tank being connected with the agitator through a line;

step (2) providing a polymerizable monomer composition and an aqueous dispersion medium into the dispersion supply tank; and;

step (3) mixing the polymerizable monomer composition and the aqueous dispersion medium by the agitator under controlled agitation to obtain a dispersion of fine droplets;

step (4) feeding back the dispersion from the outlet port of the agitator through a line into the dispersion supply tank and circulating the dispersion; the agitation being controlled by the following parameters:

R/θ≧2, and

R≧30 m/s or more, wherein the peripheral velocity (m/s) of the agitating blade or rotor of the agitator is designated by R, and the number of circulations is designated by θ; θ being represented by (throughput of the dispersion (liter/h)× agitating time (h))/(provided quantity in step (2) of the polymerizable monomer composition and the aqueous dispersion medium (liter)); the throughput being the amount of dispersion that is fed back into the dispersion supply tank in step (4); θ being ≧1; and the internal pressure of the agitator is controlled within a range between 0.01 and 15 MPa; and step (5) providing the resulting dispersion to the process for polymerizing.

2. The manufacturing method according to claim 1, wherein the polymerizable monomer composition and the aqueous dispersion medium are mixed together to form the blend thereof before providing them into the dispersion supply tank.

3. The manufacturing method according to claim 2, wherein the blend is formed as to include uniform primary droplets of the polymerizable monomer composition.

4. The manufacturing method according to claim 1, wherein the peripheral velocity R of the agitating blade or rotor is within the range between 30 and 100 m/s.

5. The manufacturing method according to claim 4, wherein the peripheral velocity R of the agitating blade or rotor exceeds 35 m/s.

6. The manufacturing method according to claim 4, wherein the peripheral velocity R of the agitating blade or rotor is 40 rn/s or more.

7. The manufacturing method according to claim 1, wherein the number of circulations θ is within the range between 1 and 20.

8. The manufacturing method according to claim 1, wherein R/θ is within the range between 2 and 100.

9. The manufacturing method according to claim 1, wherein the agitator is a dispersing machine having a combination of a stator and a rotor that are concentric comb-teeth rings, rotating the rotor at a high speed to flow the blend of the polymerizable monomer composition and the aqueous dispersion medium from the inside of the rotor to the outside of the stator, and agitating the blend through the gap between the rotor and the stator.

10. The manufacturing method according to claim 9, wherein the combination of the stator and the rotor is placed in a housing and the rotor is driven with an agitating shaft.

11. The manufacturing method according to claim 9, wherein the dispersing machine has the plural combinations of rotors and stators disposed in one to three stages.

12. The manufacturing method according to claim 9, wherein the dispersing machine is a vertical or horizontal dispersing machine with capacity of the peripheral velocity R of the rotor higher than 35 m/s.

13. The manufacturing method according to claim 1, wherein the agitator forms the fine droplets by the actions of shearing force, collision force, pressure fluctuation, cavitations, and potential cores, generated between the rotor rotating at a high speed and a screen surrounding the rotor.

14. The manufacturing method according to claim 1, wherein the agitator forms the fine droplets by compressing the dispersion to an internal wall of the agitator with a centrifugal force to form a liquid film and to touch the liquid film with the edges of the agitating blade or rotor rotating at an ultra-high speed.

15. The manufacturing method according to claim 1, wherein, in the process of forming fine droplets, the fine droplets of the polymerizable monomer composition has a volume average particle diameter of 3 to 10 μm.

16. The manufacturing method according to claim 1, wherein, in the process of forming fine droplets, the fine droplets of the polymerizable monomer composition has a particle diameter distribution of 1 to 2.

17. The manufacturing method according to claim 1, wherein, in the process of forming fine droplets, the fine droplets of the polymerizable monomer composition are formed in an aqueous dispersion medium containing a colloid of a hardly water-soluble metal hydroxide as a dispersion stabilizer.

18. The manufacturing method according to claim 1, wherein, in the process of polymerizing, the obtained colored polymer particles has having a volume average particle diameter dv of 4 to 9 μm, the a ratio dv/dp of the volume average particle diameter dv to the number average particle diameter of 1.25 or less, and a number percentage of particles having a volume average particle diameter dv of 3 μm or smaller of 8% or less.

19. The manufacturing method according to claim 1, wherein, in the process of polymerizing, core-shell structure colored polymer particles is obtained by polymerizing the polymerizable monomer composition to form colored polymer particles, using the colored polymer particles as core particles, and further polymerizing a polymerizable monomer for shell in the presence of the core particles to form polymer layer on the surface of the core particles.

* * * * *